US012076773B2

(12) United States Patent
Larsson

(10) Patent No.: US 12,076,773 B2
(45) Date of Patent: Sep. 3, 2024

(54) DEVICE AND METHOD FOR SHAPING A COMPONENT

(71) Applicant: Alexander Wilden Beteiligungen GmbH, Aachen (DE)

(72) Inventor: Jan Rolf Larsson, Lulea (SE)

(73) Assignee: Alexander Wilden Beteiligungen GmbH, Aachen (DE)

( * ) Notice: Subject to any disclaimer, the term of this patent is extended or adjusted under 35 U.S.C. 154(b) by 344 days.

(21) Appl. No.: 17/610,311

(22) PCT Filed: Apr. 29, 2020

(86) PCT No.: PCT/EP2020/061839
§ 371 (c)(1),
(2) Date: Nov. 10, 2021

(87) PCT Pub. No.: WO2020/229171
PCT Pub. Date: Nov. 19, 2020

(65) Prior Publication Data

US 2022/0241836 A1 Aug. 4, 2022

(30) Foreign Application Priority Data

May 14, 2019 (DE) ..... 102019112635.5

(51) Int. Cl.
*B21D 22/06* (2006.01)
*B21D 22/02* (2006.01)
(Continued)

(52) U.S. Cl.
CPC ..... *B21D 22/06* (2013.01); *B21D 22/022* (2013.01); *B21D 37/16* (2013.01); *B21D 53/30* (2013.01)

(58) Field of Classification Search
CPC ..... B21D 37/16; B21D 22/06; B21D 22/022; B21D 53/30
See application file for complete search history.

(56) References Cited

U.S. PATENT DOCUMENTS 1,935,848 A 11/1933 Kielberg
2,960,142 A 11/1960 Cimochowski
(Continued)

FOREIGN PATENT DOCUMENTS

CN 106077209 A 11/2016
DE 19845186 A1 4/2000
(Continued)

OTHER PUBLICATIONS

International Search Report, PCT Application No. PCT/EP2020/061839, mailed Jul. 21, 2020 (3 pages).
Chinese Office Action, dated Mar. 31, 2023.

*Primary Examiner* — Teresa M Ekiert
(74) *Attorney, Agent, or Firm* — Occhiuti & Rohlicek LLP

(57) ABSTRACT

Device for shaping a component, comprising a first tool and a second tool, which can be moved relative to one another along a movement axis to shape a component to be placed between the tools, wherein a surface of the first tool can be extended transverse to the movement axis in an extension region. With the described device and with the described method, components, in particular sheet steel components, can be shaped in such a way that contours that are oriented in parallel to a movement axis of the tools are particularly well formed. In particular circular shapes can thus be formed with particularly good accuracy. Negative influences of fluctuations of the thickness of the component can be offset. The device and the method are particularly suitable for the production of wheel rims for motor vehicles.

20 Claims, 2 Drawing Sheets

Figure 1:
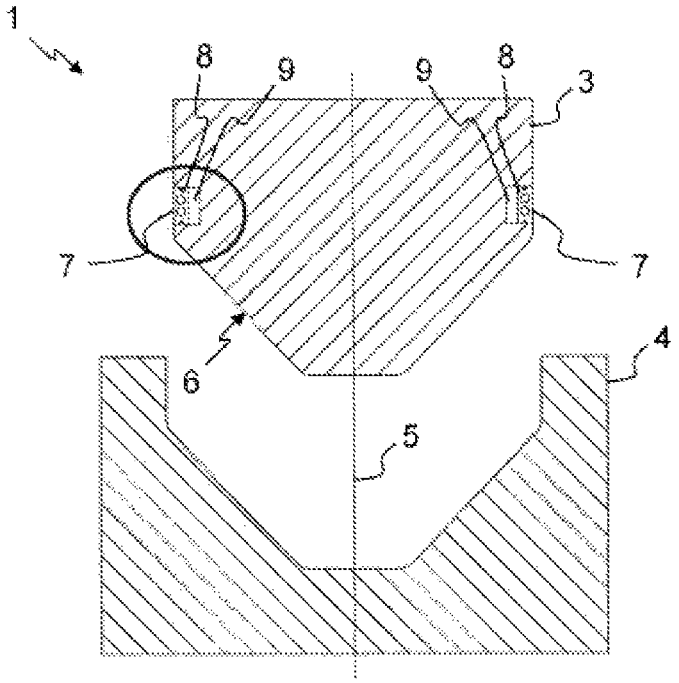

(51) Int. Cl.
*B21D 37/16* (2006.01)
*B21D 53/30* (2006.01)

(56) References Cited

U.S. PATENT DOCUMENTS 5,970,776 A 10/1999 Ijima et al.
9,943,898 B2 * 4/2018 Kettler ..... B21D 37/16

FOREIGN PATENT DOCUMENTS

| | | | |
|---|---|---|---|
| DE | 10313072 | A1 | 9/2004 |
| DE | 102010062977 | A1 | 6/2012 |
| DE | 102011108912 | A1 | 1/2013 |
| DE | 102014110228 | A1 | 1/2016 |
| DE | 102015215184 | A1 | 2/2017 |
| EP | 3088092 | A1 | 11/2016 |

* cited by examiner

DEVICE AND METHOD FOR SHAPING A COMPONENT

CROSS-REFERENCE TO RELATED APPLICATION

This application is a 371 application of International Application No. PCT/EP2020/061839 filed Apr. 29, 2020, which claims the benefit of the DE 102019112635.5, filed May 14, 2019, the contents of which are hereby incorporated by reference.

The present invention relates to a device and a method for shaping a component, in particular a sheet steel component. The device and the method are particularly suitable for the production of wheel rims for motor vehicles.

It is known from the prior art to shape components, in particular ones made of steel, using pressing tools. For this purpose, the component to be formed is usually placed between a punch and a die and pressed into the die with the punch. As a result, the component takes on the shape of the punch and die. In particular, so-called deep drawing is known.

Known methods are essentially limited to the formation of surfaces that are largely oriented transverse to the direction of movement of the punch. Surfaces that are aligned parallel to the direction of movement of the punch, on the other hand, can only be shaped very imprecisely. In particular, with fluctuations in the component thickness, the shaping of such surfaces according to the prior art is only possible to an unsatisfactory extent.

Starting from this, the present invention is based on the object of at least partially overcoming the problems known from the prior art and, in particular, of providing a device and a method for shaping a component with which components can be shaped with particularly low restrictions on the shape to be obtained.

This object is achieved with the features of the independent claims. Further advantageous embodiments of the invention are specified in the dependently formulated claims. The features listed individually in the dependently formulated claims can be combined with one another in a technologically meaningful manner and can define further embodiments of the invention. In addition, the features specified in the claims are described and explained in more detail in the description, further preferred embodiments of the invention being thereby shown.

According to the invention, a device for shaping a component is presented. The device comprises a first tool and a second tool, which can be moved relative to one another along a movement axis in order to shape a component to be placed between the tools. The surface of the first tool can be extended in an extension region transverse to the movement axis.

The described device is preferably configured for shaping sheet steel components. With the described device, components can be shaped in particular in the manner of deep drawing. In particular, sheet steel components can be shaped after a heat treatment using the described device. Accordingly, the device is preferably suitable for shaping heated components. In particular, the device can preferably withstand component temperatures of up to 900° C. The device can be used in particular for the production of round shapes. For this purpose, parts of a product to be manufactured can in particular also be shaped with the described device and then assembled. The described device is preferably used for shaping a component for a wheel rim for a motor vehicle. The component is not part of the described device.

The described device is preferably designed as a press. In particular, the component can be shaped and hardened with the described device in the manner of press hardening. For this purpose, at least part of the first tool and/or at least part of the second tool is preferably designed to be cooled. As a result of the cooling, a structural transformation can be generated in the component during the pressing. This allows the component to be hardened. If the cooling takes place only locally, local hardening can be achieved.

The device comprises the first tool and the second tool. The tools are preferably a punch or a die, respectively. The first tool is preferably designed as a punch and the second tool as a die. Alternatively, it is preferred that the first tool be designed as a die and the second tool as a punch. If the two tools are at a distance from one another, the component to be shaped can be placed between the two tools. This can be referred to as an open state of the device.

The two tools can be moved relative to one another. This can be done hydraulically in particular. The component can be shaped by moving the two tools relative to one another. For this purpose, it is preferred that the tools can be pressed against one another with a pressure that is sufficient to shape the component.

The two tools can be effected relative to one another in that the first tool is held movably and the second tool is held stationary. Alternatively, the two tools can be moved relative to one another in that the second tool is held movably and the first tool is held stationary. Both tools can also be held movably.

The first tool and the second tool are preferably matched to one another. The first tool thus forms a counterpart to the second tool, or vice versa. The two tools can be moved toward one another in such a way that only a gap remains free between the two tools which corresponds to the shape of the component to be formed. This state can be referred to as a closed state. In the closed state, the first tool preferably engages the second tool, or vice versa.

In the open state, the component to be shaped can therefore be placed between the two tools. By moving the two tools relative to one another, the tools can be brought into the closed state, whereby the component is shaped.

The tools are moved along the movement axis. The first tool and/or the second tool are preferably designed to be rotationally symmetrical. In that case, the axis of rotation preferably coincides with the movement axis. As a result of the movement along the movement axis, a force can be exerted on the component parallel to the movement axis. Due to the shape of the two tools, this force can be deflected in such a way that force components also arise perpendicular to the movement axis. The component can thus be shaped in such a way that regions of its surface are arranged at an angle to the movement axis. However, only with difficulty can regions of the surface of the component parallel to the movement axis be brought into the desired shape by the relative movement of the two tools.

In particular, to shape these regions, the surface of the first tool can be extended in an extension region transverse to the movement axis. As a result, a further force, which in particular has a component perpendicular to the movement axis, can be exerted on the component. This force preferably has only one component perpendicular to the movement axis. This additional force can in particular shape the component in such a way that regions of its surface are arranged parallel to the movement axis.

The fact that the surface can be extended transverse to the movement axis in the extension region means that the first tool can be enlarged in the extension region. Preferably, only the extension region can be extended, while adjacent regions preferably remain unchangeable. In particular, it is therefore preferred that the extension region can be extended with respect to adjacent regions. The surface of the first tool can therefore be extended in such a way that a projection is created in the extension region.

An extension transverse to the movement axis is understood to mean that at least one component of the surface is displaced transverse to the movement axis. The extension region can therefore also be extended obliquely to the movement axis. However, it is preferred that the surface in the extension region be extended perpendicular to the movement axis. As a result, the component can have a surface parallel to the movement axis in a corresponding region.

The fact that the surface can be extended in the extension region goes beyond uniform thermal extension of the entire first tool. The extension region can preferably be extended by moving at least one extension element.

In the described device, the surface of the first tool can be extended. As described, the first tool can be designed as a punch or a die. As a result, the surface of the punch or die can be extensible. It is preferred that the surface of the stamp can be extended.

It is also possible for both the surface of the first tool and the surface of the second tool to be extended. It is preferred that regions of the surfaces of the two tools that correspond to one another can be extended.

According to a preferred embodiment of the device, the surface of the first tool in the extension region is formed parallel to the movement axis.

The component can essentially be shaped by moving the two tools toward one another. The component is given a shape predetermined by the shape of the two tools. The formation of a surface parallel to the movement axis is difficult, as described above. With the described device, however, the formation of such a surface is particularly feasible due to the extensibility of the extension region.

It is preferred that in this embodiment the surface of the second tool be formed parallel to the movement axis in a region assigned to the extension region. The region of the surface of the second tool which forms the counterpart for the extension region is assigned to the extension region. In the closed state of the device, the extension region of the surface of the first tool and the associated region of the surface of the second tool adjoin the component on opposite sides of the same point on the component.

According to a further preferred embodiment of the device, the first tool has a ring which is designed to run around the movement axis and which can be extended transverse to the movement axis.

In this embodiment, the extension element is designed as a ring. The ring is preferably inserted into a groove in the surface of the first tool, which groove runs around the movement axis. If the first tool is designed to be rotationally symmetrical with respect to the movement axis, the ring is preferably a circular ring.

The ring is preferably designed to be elastic. Thus, the ring can be extended uniformly. As a result, a correspondingly uniform pressure can be exerted on the component.

The ring preferably has a closed surface. As a result, a continuous surface of the component can be contacted by the ring and thus shaped.

In another preferred embodiment, a number of extension elements can be provided instead of a continuous ring. The extension elements are preferably arranged equidistantly distributed over the circumference of the first tool. The extension elements can be rigid. The extension region of the surface of the first tool can in this case be extended by radial displacement of the extension elements, with a corresponding gap between adjacent extension elements being enlarged. The corresponding gap between adjacent extension elements is preferably minimized in such a way that the adjacent extension elements are in contact with one another in the initial state. The initial state is the state from which the extension region can be extended. The extension region is preferably in the initial state while the two tools for shaping the component are moved relative to one another.

According to a further preferred embodiment of the device, the ring is designed to be adjacent to a hydraulic chamber in such a way that the ring can be extended by increasing a pressure of a hydraulic medium accommodated in the hydraulic chamber.

The ring is preferably inserted into a groove in the surface of the first tool, which groove runs around the movement axis. The ring is preferably smaller than the groove in such a way that the groove is not completely filled by the ring. The ring and groove preferably have the same outer diameter. The ring preferably has a larger inner diameter than the groove. This creates a cavity between the ring and the boundary of the groove. This cavity is preferably used as a hydraulic chamber. The hydraulic chamber is preferably sealed off by means of seals. The seals are preferably arranged on the ring and/or on the boundary of the groove where the ring and the boundary of the groove meet.

The hydraulic chamber is preferably configured to accommodate a hydraulic medium. The hydraulic chamber is preferably filled with the hydraulic medium. Water and/or hydraulic oil are preferred as the hydraulic medium.

If the pressure of the hydraulic medium in the hydraulic chamber is increased, the ring is pressed outward and extends in this respect. The pressure in the hydraulic chamber can in particular be increased by means of a suitable pump.

According to a preferred embodiment of the device, the ring has at least one cooling line.

The extension region can be cooled with the at least one cooling line. The at least one cooling line is preferably configured to have a cooling medium flowing through it. The preferred cooling medium is water. The water can in particular be pumped through the at least one cooling line by means of a pump.

The ring preferably has two cooling lines. Thus, on the one hand, the complexity of the ring can be kept low and, on the other hand, sufficiently uniform cooling can be achieved.

In the case of two or more cooling lines, it is preferred that the cooling lines be arranged parallel to one another. Particularly uniform cooling can thereby be achieved.

According to a preferred embodiment of the device, the extension region of the surface of the first tool transitions continuously into adjacent regions in an initial state.

The initial state is the state from which the extension region can be extended. In this state, a transition between the extension region and regions adjoining it is smooth. So there is no step between the extension region and the regions adjacent to it.

In the initial state, the component can be shaped with the described device solely by the relative movement between the two tools. The extensibility of the extension region is initially of no importance. Preferably, only after the component has been shaped by the relative movement of the two tools is the component also shaped by extending the extension region. In this case, the extension region is preferably extended in such a way that, starting from the initial state, a step is created between the extension region and regions adjoining it.

A method for shaping a component is presented as a further aspect. The method comprises:

a) placing the component to be shaped between a first tool and a second tool, b) shaping the component by moving the first tool and the second tool relative to one another along a movement axis, and c) further shaping of the component by extending the surface of the first tool transverse to the movement axis in an extension region of the surface.

The described special advantages and design features of the described device for shaping a component can be used and transferred to the described method for shaping a component, and vice versa. In particular, the described device is preferably configured to carry out the described method. In particular, the described method is preferably carried out with the described device.

Steps a), b) and c) are preferably carried out in the order mentioned. Step a) is preferably completed before the start of step b). Step b) is preferably completed before step c). Alternatively, it is preferred that step c) begins before step b) is ended, so that steps b) and c) at least partially overlap in time.

In step b) the component is shaped by the relative movement between the two tools. This can be called a main shaping. In doing so, the component can already be given the desired shape to a large extent. This applies in particular to regions of the component in which the surface of the component are not to be formed parallel to the movement axis of the two tools. In particular, such surfaces can be obtained in step c). For this purpose, the extension region is extended in step c). This shaping is referred to as a further shaping and takes place in addition to the main shaping according to step b).

According to a preferred embodiment of the method, the component is shaped in step c) in an edge region.

Due to the extensibility of the extension region of the surface of the first tool, the edge regions can be shaped particularly precisely in the present embodiment.

According to a further preferred embodiment of the method, the component is shaped in step c) with a pressure between 50 and 750 bar.

The specified pressure is preferably the pressure of the hydraulic medium in the hydraulic chamber. This proceeds via the extension element, in particular via the ring, onto the component.

According to a further preferred embodiment of the method, the extension region of the surface of the first tool is cooled in step c).

The cooling is preferably carried out by means of the cooling lines in the ring, in particular by pumping a cooling medium through the cooling lines.

Figure 2:
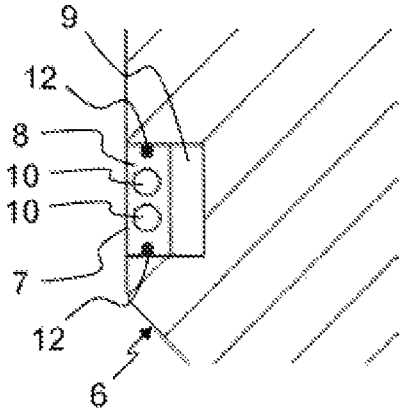
Figure 3:
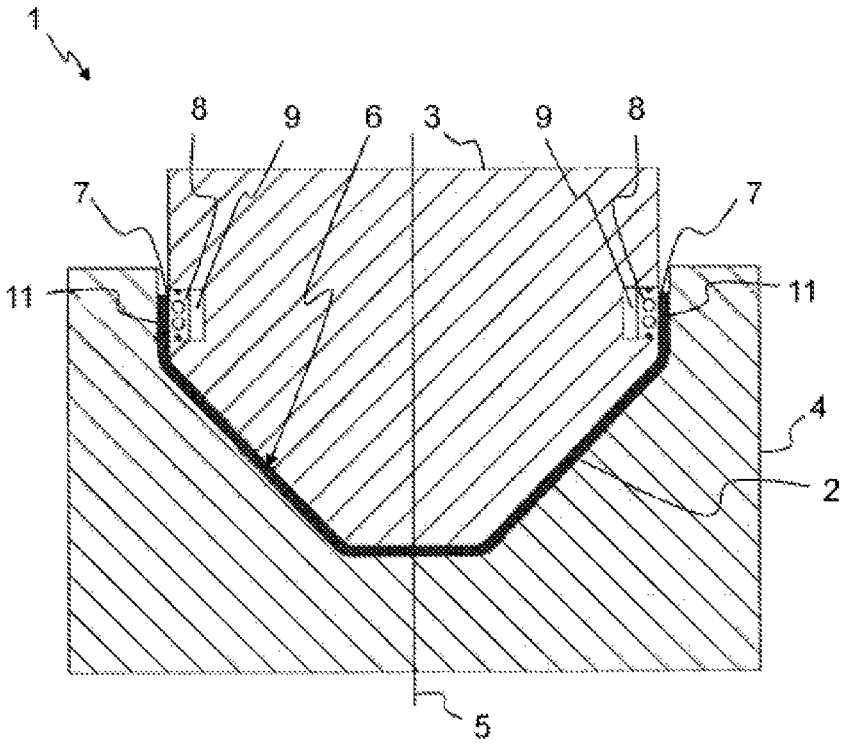
Figure 4:
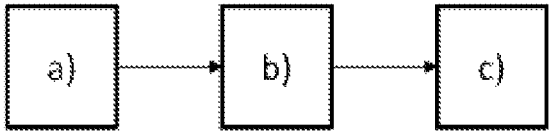

In the following, the invention and the technical environment will be explained in more detail with reference to the drawings. It should be noted that the invention is not supposed to be limited by the depicted embodiments. In particular, unless explicitly stated otherwise, it is also possible to extract partial aspects from the facts described in the figures and to combine them with other components and insights from the present description and/or the figures. In particular, it must be noted that the figures and in particular the depicted size ratios are only schematic. Identical reference signs denote identical objects, so that explanations from other figures can be used in a supplementary manner, if necessary. In the drawings:

FIG. 1: is a schematic side sectional view of a device according to the invention, FIG. 2: is an enlarged detail of FIG. 1, FIG. 3: is a schematic side sectional view of the device from FIG. 1 with a component after shaping, and FIG. 4: shows a sequence of a method for shaping a component which can be carried out with the device from FIGS. 1 to 3.

FIG. 1 shows a device 1 for shaping a component 2. In FIG. 1, the device 1 is shown without component 2. However, a component 2 is shown in FIG. 3. The device 1 comprises a first tool 3 and a second tool 4, which can be moved relative to one another along a movement axis 5 in order to form a component 2 placed between the tools 3, 4. In the state of the device 1 shown in FIG. 1, the component 2 can be placed between the tools 3, 4. The state of the device 1 shown in FIG. 1 can be referred to as an open state. The tools 3, 4 can then be moved toward one another starting from the state shown in FIG. 1, so that the component 2 is shaped and the state shown in FIG. 3 is achieved, which can be referred to as a closed state.

In the embodiment shown, the first tool 3 is designed as a punch and the second tool 4 as a die. The relative movement between the first tool 3 and the second tool 4 can be realized in the embodiment shown, for example, in that the first tool 3 is moved downward while the second tool 4 is stationary.

A surface 6 of the first tool 3 can be extended in an extension region 7 transverse to the movement axis 5. For this purpose, the first tool 3 has a ring 8 which is designed to run around the movement axis 5 and which can be extended transverse to the movement axis 5. The ring 8 is formed adjacent to a hydraulic chamber 9 in such a way that the ring 8 can be extended by increasing a pressure of a hydraulic medium accommodated within the hydraulic chamber 9.

FIG. 2 shows an enlarged view of the region of the device 1 from FIG. 1 that is indicated by a circle. The hydraulic chamber 9 is delimited by the ring 8. The hydraulic chamber 9 is closed off by seals 12 on the ring 8. The ring 8 also has two cooling lines 10. Like the ring 8, the cooling lines 10 are designed to run around the movement axis 5. If a cooling medium is flowing through the cooling lines 10, the component 2 can be cooled in the regions which adjoin the ring 8.

The surface 6 of the first tool 3 is formed in the extension region 7 parallel to the movement axis 5. The extension region 7 of the surface 6 of the first tool 3 transitions steplessly into adjacent regions in an initial state. The initial state is shown in FIG. 2.

In FIG. 3, the device 1 from FIGS. 1 and 2 is shown together with a component 2. The tools 3, 4 are moved toward one another along the movement axis 5 to the extent that the tools 3, 4 engage and only leave a gap between them which corresponds to the shape of the shaped component 2. The state of the device 1 shown in FIG. 3 can be referred to as a closed state. In this state, the ring 8 adjoins edge regions 11 of the component 2. By extending the ring 8, the component 2 can be shaped in the edge regions 11.

The second tool 4, the surface 6 of the first tool 3, the extension region 7 of this surface 6, the ring 8 and the hydraulic chamber 9 are also shown in FIG. 3.

FIG. 4 shows the schematic sequence of a method for shaping a component 2. The method can be carried out with the device 1 shown in FIGS. 1 to 3. The reference numbers relate to these figures. The method comprises:

a) placing the component 2 to be shaped between a first tool 3 and a second tool 4, b) shaping the component 2 by moving the first tool 3 and the second tool 4 relative to one another along a movement axis 5, and c) further shaping the component 2 in an edge region 11 with a pressure between 50 and 750 bar by extending the surface 6 of the first tool 3 transverse to the movement axis 5 in an extension region 7 of the surface 6. In this process, the extension region 7 of the surface 6 of the first tool 3 is cooled.

With the described device 1 and the described method, components 2, in particular sheet steel components, can be shaped in such a way that contours are formed particularly well and are aligned parallel to a movement axis 5 of the tools 3, 4. In particular, circular shapes can thus be formed with particularly good accuracy. Negative influences of fluctuations of the thickness of the component 2 can be offset. The device 1 and the method are particularly suitable for the production of wheel rims for motor vehicles.

LIST OF REFERENCE SIGNS

1 device
2 component
3 first tool
4 second tool
5 movement axis
6 surface
7 extension region
8 ring
9 hydraulic chamber
10 cooling line
11 edge region
12 seal

The invention claimed is:

1. A device for shaping a component, the device comprising a first tool and a second tool, which can be moved relative to one another along a movement axis to shape a component to be placed between the tools, wherein a surface of the first tool can be extended transverse to the movement axis in an extension region of the surface of the first tool with respect to adjacent regions of the surface of the first tool, and wherein the first tool has an elastic ring, which is formed circumferentially around the movement axis and can be extended transverse to the movement axis, or a plurality of extension elements that are distributed equidistantly over the circumference of the first tool, wherein the extension region of the surface of the first tool can be extended by radial displacement of the extension elements, with a corresponding gap between adjacent of the extension elements being enlarged.

2. The device according to claim 1, wherein the surface of the first tool in the extension region is formed parallel to the movement axis.

3. The device according to claim 2, wherein the first tool has a ring which is formed circumferentially around the movement axis and can be extended transverse to the movement axis.

4. The device according to claim 2, wherein the extension region of the surface of the first tool transitions continuously into adjacent regions in an initial state.

5. The device according to claim 1, wherein wherein the first tool has a plurality of extension elements that are distributed equidistantly over the circumference of the first tool, wherein the extension region of the surface of the first tool can be extended by radial displacement of the extension elements, with a corresponding gap between adjacent of the extension elements being enlarged.

6. The device according to claim 5, wherein the extension region of the surface of the first tool transitions continuously into adjacent regions in an initial state.

7. The device according to claim 1, wherein the ring is formed adjacent to a hydraulic chamber in such a way that the ring can be extended by increasing a pressure of a hydraulic medium accommodated within the hydraulic chamber.

8. The device according to claim 7, wherein the ring has at least one cooling line.

9. The device according to claim 7, wherein the extension region of the surface of the first tool transitions continuously into adjacent regions in an initial state.

10. The device according to claim 1, wherein the ring has at least one cooling line.

11. The device according to claim 10, wherein the extension region of the surface of the first tool transitions continuously into adjacent regions in an initial state.

12. The device according to claim 1, wherein the extension region of the surface of the first tool transitions continuously into adjacent regions in an initial state.

13. A method for shaping a component using a device that comprises first and second tools that are movable relative to each other along a movement axis to shape a component that is placed between the tools, wherein a surface of the first tool can be extended transverse to the movement axis in an extension region of the surface of the first tool with respect to adjacent regions of the surface of the first tool, and wherein the first tool has either an elastic ring that is formed circumferentially around the movement axis and can be extended transverse to the movement axis or a plurality of extension elements that are distributed equidistantly over the circumference of the first tool, wherein the extension region of the surface of the first tool is extendable by radial displacement of the extension elements, with a corresponding gap between adjacent of the extension elements being enlarged, the method comprising:

a) placing the component to be shaped between the first tool and the second tool, b) shaping the component by moving the first tool and the second tool relative to one another along a movement axis, and c) further shaping the component by extending the surface of the first tool transverse to the movement axis in the extension region of the surface.

14. The method according to claim 13, wherein the component is shaped in step c) in an edge region.

15. The method according to claim 14, wherein the component is shaped in step c) with a pressure between 50 and 750 bar.

16. The method according to claim 14, wherein the extension region of the surface of the first tool is cooled in step c).

17. The method according to claim 13, wherein the component is shaped in step c) with a pressure between 50 and 750 bar.

18. The method according to claim 17, wherein the extension region of the surface of the first tool is cooled in step c).

19. The method of claim 17, wherein the surface of the first tool in the extension region is formed parallel to the movement axis.

20. The method according to any of claim 13, wherein the extension region of the surface of the first tool is cooled in step c).

* * * * *